US005351933A

United States Patent [19]

Schonks

[11] Patent Number: 5,351,933

[45] Date of Patent: Oct. 4, 1994

[54] QUICK-ACTING GATE VALVE

[75] Inventor: Bernhard Schonks, Frankfurt am Main, Fed. Rep. of Germany

[73] Assignee: Luwa Fahrzeugklimatechnik GmbH, Frankfurt, Fed. Rep. of Germany

[21] Appl. No.: 150,470

[22] Filed: Nov. 10, 1993

[30] Foreign Application Priority Data

Nov. 19, 1992 [DE] Fed. Rep. of Germany ..... 4238942

[51] Int. Cl.[5] ..... F16K 31/124

[52] U.S. Cl. ..... 251/58; 251/303

[58] Field of Search ..... 251/58, 902, 298, 303; 137/520, 521

[56] References Cited

U.S. PATENT DOCUMENTS

| | | | |
|---|---|---|---|
| 3,057,373 | 10/1962 | Bragg | 137/521 |
| 4,316,408 | 2/1982 | Bolton et al. | 251/298 X |
| 4,605,198 | 8/1986 | Greiner | 251/58 |
| 5,106,052 | 4/1992 | Datta et al. | 251/58 X |
| 5,139,048 | 8/1992 | Armstrong | 251/58 X |

FOREIGN PATENT DOCUMENTS

| | | | |
|---|---|---|---|
| 361892 | 3/1987 | Fed. Rep. of Germany | B61D 27/00 |
| 427514 | 6/1967 | Switzerland | A62B 13/00 |

OTHER PUBLICATIONS

German periodical entitled "Die Kalte und Kimatechnik," pub. date Nov. 1986, pp. 558 and 559.

*Primary Examiner*—Martin P. Schwadron
*Assistant Examiner*—Kevin L. Lee
*Attorney, Agent, or Firm*—Webb Ziesenheim Bruening Logsdon Orkin & Hanson

[57] ABSTRACT

The present invention is concerned with a quick-acting gate valve for installation on intake and exhaust openings of ventilation systems, in particular, of rapid railway vehicles, comprising a frame containing at least one passage slot provided with an adjustable closure element which relative to the passage slot can be placed into closed and open positions by a servo drive controlled in response to air pressure. In order to permit actuation of a quick-acting gate valve of this type substantially in a friction-free manner during opening and closing, the valve, in the practice of the invention, is so designed that the edges laterally confining the at least one passage slot relative to the in-flow direction are of a convex curvature. Behind the edges, the closure element is designed and arranged in the form of a similarly convex yet lesser curved leaf spring, the length of which corresponds at least to the length of the convex-curved edges of the passage slot. One end of the leaf spring is held on the frame while the other end thereof is displaceably guided on the frame.

7 Claims, 2 Drawing Sheets

QUICK-ACTING GATE VALVE

BACKGROUND OF THE INVENTION

1. Field of the Invention

The invention is concerned with a quick-acting gate valve to be installed on intake and exhaust openings of a ventilating system, in particular of rapid railway vehicles. In rapid railway vehicles, when driving through tunnels or when meeting other trains, the relatively large intake and exhaust openings of the ventilating systems enable pressure waves to pass into the interior of the wagon causing inconvenience to passengers, which could be eliminated by a rapid closure of the openings upon occurrence of the pressure wave.

2. Description of the Prior Art

Conventional quick-acting gate valves comprise a frame having at last one passage slot provided with an adjustable closure element which, relative to the passage slot, can be placed into closing and opening positions by a servo drive controlled in response to the air pressure. Pressure wave valves of the type published, for example, by German Patent No. 36 18 292 are of slot-slide configuration. They comprise two outer plates having opposite openings and a movable central plate equally provided with slots and being displaced by mechanical movement such that the slots are no longer mating. Due to the mechanical movement, friction and wear occur on the plates. Moreover, the servo drive has to withdraw the central plate and/or a restoring spring has to be provided in addition to the plate.

Swiss Patent No. 427 514 teaches a quick-acting gate device for installation on air exhaust openings of shelters by way of which external pressure or suction waves are intercepted. At least one air passage slot is defined by two frames which, relative to a strip-type closure member disposed therebetween, comprise concave seat faces for the closure member which in the event of a pressure wave gets into abutment with one of the pairs of seat faces and in the event of a suction wave gets into abutment with the other pair of seat faces, at the same time closing the air passage slot. Accordingly, this valve is a so-called knock valve which is not suitable for the present purposes, let alone that the valve does not permit pointed or controlled opening and closing operations. The same applies to a valve of a corresponding design intended for an automatic so-called blast control of the type as set out in the German periodical "Die Kälte- und Klimatechnik", November 1986, pp. 558–559.

SUMMARY OF THE INVENTION

The object of this invention is to improve a quick-acting gate valve so that the opening and closing movements of the closure member can take place in a manner substantially friction-free and that the closure member, after elimination of the closure load, is automatically restored into its opening position.

A quick-acting gate valve of this type is comprised of at least one passage slot, the laterally confining edges of which relative to the in-flow direction are of a convex curvature with the closure member behind such edges being designed and arranged in the form of a leaf spring of a lesser curvature. The length of the leaf spring corresponds at least to the length of the convex-curved edges of the passage slot, and one end of the leaf spring being held on the frame and the other end guided displaceably on the frame.

As the leaf spring of the quick-acting gate valve according to the invention at a given actuation pulse is only placed in abutment with the convex-curved edges of the passage slot to spring back from the abutting closure position into the opening position once the closure load is removed, thus only communicating through the ends thereof with the frame, the friction compared to the one prior art valve constructed with slide valves is substantially reduced.

The control pulse for actuating the servo drive which can be—as it has been in the past—a small pneumatic cylinder or an electromagnetic drive, is equally supplied—as it has been in the past—by a pressure wave sensor which can be, for example, a conventional pressure wave ventilator well known in the art.

Moreover, a control element extending transverse of the leaf spring with one end thereof firmly disposed on the frame forming the casing of the quick-acting valve is positioned in the area of the leaf spring in the open position. One end of the control element cooperates with the leaf spring, the other end being coupled to the servo drive, thereby insuring not only a favorable articulation of the servo drive relative to the leaf spring, but the control element, yet to be described in greater detail, permits that all leaf springs pertaining to a whole passage slot series can be simultaneously seized, meaning that only a single servo drive is required for all leaf springs.

BRIEF DESCRIPTION OF THE DRAWING

A preferred embodiment of the invention will hereinafter be described in conjunction with the accompanying drawing, wherein.

DESCRIPTION OF THE PREFERRED EMBODIMENT

Figure 2:
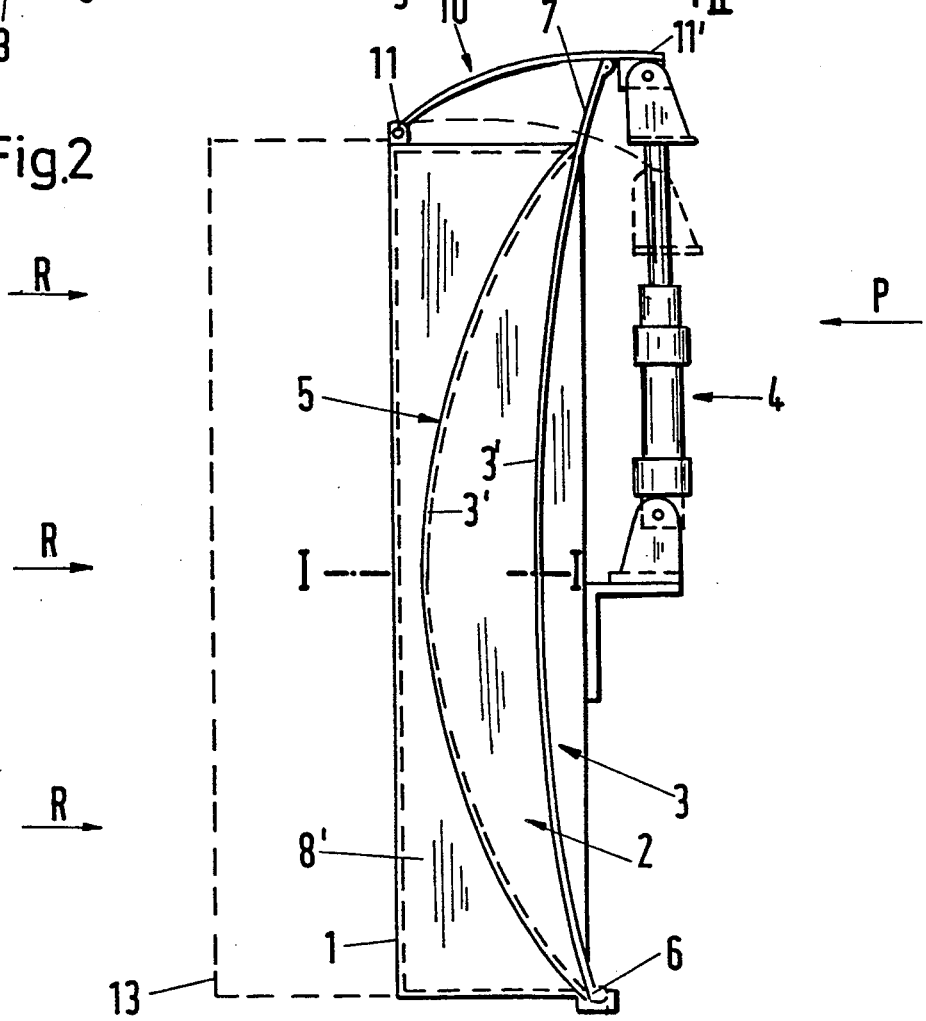
FIG. 2 is a sectional view of the quick-acting gate valve along line II—II of FIG. 1.

Referring now to the drawing and more particularly to FIG. 2, the quick-acting gate valve is shown to comprise a frame 1 having at least one passage slot 2 which is provided with an adjustable closing member 3 which, relative to the passage slot 2, can be placed by a servo drive 4 controlled in response to the air pressure into closing and opening positions. Now, it is important for the quick-acting valve of the invention that the edges 5 laterally confining the passage slot 2 (a plural number of which are shown) and forming the valve seats for the respective leaf spring 3' (made of spring steel), relative to the in-flow direction R are of a convex curvature and that behind the edges 5 the closure element 3 is designed and arranged in the form of a similarly convex yet lesser curved leaf spring 3', the length L of which corresponds at least to the length of the convex-curved edges 5 of the passage slot 2, with one end 6 of the leaf spring being held on frame 1 and with the other end region 7 thereof being guided in a displaceable manner on frame 1.

In its relaxed state, the leaf spring 3' has a radius of curvature greater than that of the edges 5. When in the closed position, the radii of curvatures of the leaf springs 3' and the edges 5 are equal.

As conveyed in the embodiment shown by FIG. 2, the end region 7 of the leaf spring 3' displaceably guided on frame 1 is connected to the servo drive 4 though a control element 10 extending transverse of the leaf spring 3', with one end 11 thereof firmly disposed on frame 1, which end 11 cooperates with leaf spring 3' while the other end 11' is coupled to the servo drive 4. Apart from the fact that such a design could be provided for each of the leaf springs 3', it would also be possible for the control element 10 to seize all leaf springs 3' and for only one servo drive 4 to hinge, as shown in FIG. 2, on the control element 10 (see FIG. 4). Incidentally, the afore-described design also insures a geographically advantageous association of the servo drive(s) 4, as shown, in the vertical direction and in the flow shadow behind the leaf spring 3'.

Thus in operation, the inherent tension of the leaf spring 3' causes the leaf spring 3' to spring outwardly and open passage slot 2. When the servo drive 4 is actuated, the servo 4 acts to pull the leaf spring 3' downwardly such that the leaf spring 3' conforms to the convex shape of the edges 5 to close off the passage slot 2.

Figure 1:
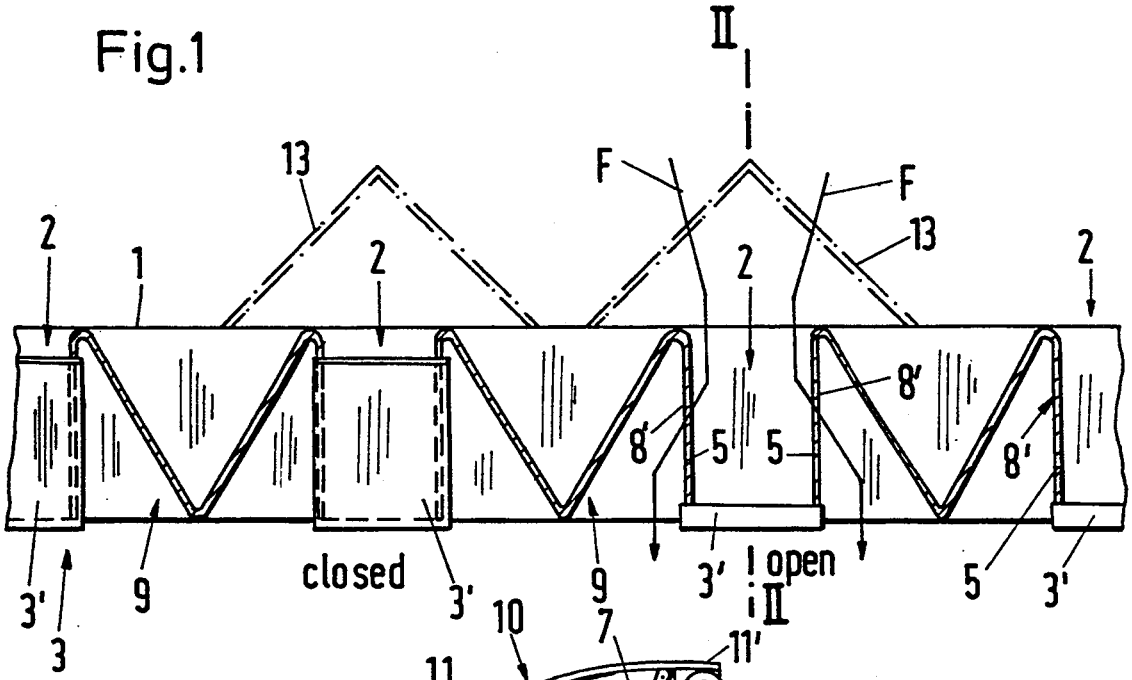
FIG. 1 is a sectional view of the quick-acting gate valve along line I—I of FIG. 2.
Figure 3:
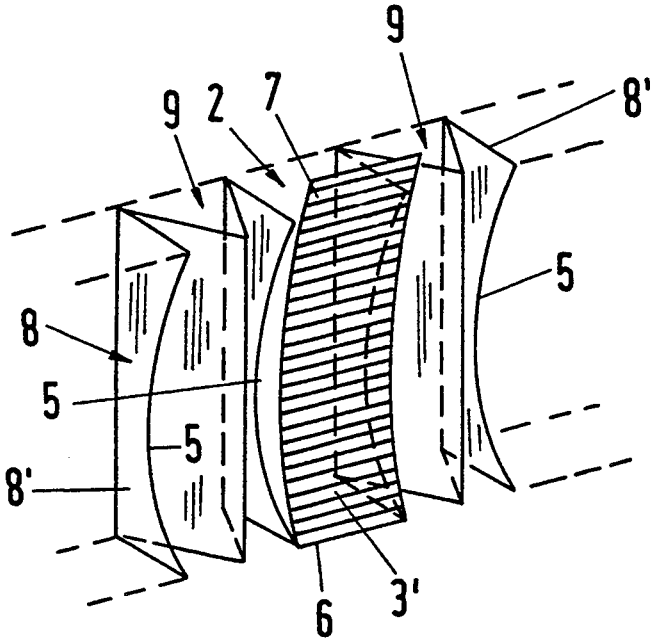
FIG. 3 is a simplified and perspective view of the quick-acting gate valve.

As conveyed in the embodiment shown by FIG. 3, the convex-curved edges 5 are formed as edges of bridges 8 located in the frame and forming flank legs 8' of M-profiles 9 located in the frame. Two adjacent M-profiles 9 thus confine with their flank legs 8' one passage slot 2. As shown by the flow arrows F in FIG. 1, favourable and largely turbulence-free conditions thereby arise for the off-flowing air with the valve opened. As shown in FIG. 1, flow-controlling elements 13 are provided in the in-flow direction R ahead of the passage slots 2 which, in suitable manner, are equally fixed to frame 1. The flow guiding elements 13 also can be designed as snow-repellant air grids.

As shown in FIG. 2, one end 6 of the leaf spring 3' is firmly bonded with frame 1, for example by folding. The guidance of the protruding end region 7, especially when coupling the same to the control element 10, does not require any special configuration of the frame 1, as the leaf springs 3' in that region are simply in abutment. The slightly convex shape of the leaf springs 3' is important inasmuch as in case of load the direction of adjustment vis-á-vis the edges 5 is safeguarded. For that matter planar leaf springs could also be used. However, in that case, provision would have to be made to ensure that such leaf springs, when loaded, could only bend toward edges 5 and get into abutment therewith.

Figure 4:
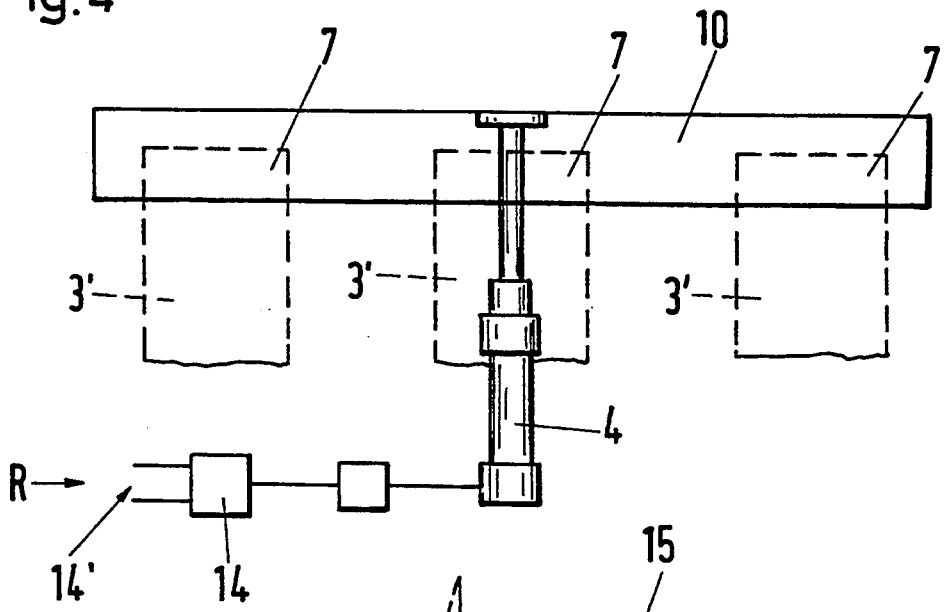
FIG. 4 is a schematical view of the upper part of the valve viewed in the direction of arrow P according to FIG. 2.
Figure 5:
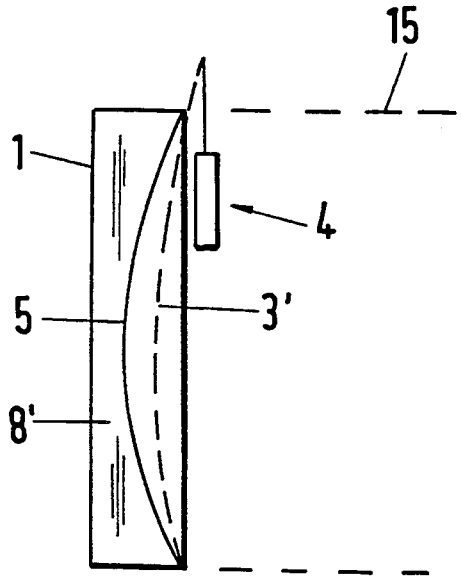
FIG. 5 is a slightly different form of embodiment of FIG. 2.

FIG. 4 shows the control element 10 to which is centrally hinged the servo drive 4, formed as a servo cylinder, and to which are hinged three leaf springs 3' by the ends 7 thereof. The servo drive 4 receives the control pulse by a differential pressure gauge 14 only schematically shown in FIG. 4 and staggered by 90° with the opening 14' thereof pointing toward the in-flow direction R at a suitable point externally of the vehicle. The closing position of all leaf springs 3' with the control element 10 is shown in FIG. 2 in broken lines. Through a correspondingly dimensioned channel 15 in the flow direction R behind the frame 1, the air is passed into the interior of the vehicle. FIG. 5 schematically shows an embodiment similar that shown in FIG. 2, except the servo drive 4 is directly hinged to the leaf spring 3'.

While a full and complete description of the preferred embodiment of the invention has been set forth in accordance with the dictates of the Patent Statutes, it should be understood that modifications can be made without departing from the spirit hereof or the scope of the appended claims.

What I claim is:

1. A quick-acting gate valve comprising a frame, provided with a least one passage slot confined by edges and having an adjustable closure element which, relative to the passage slot, is to be opened and closed by a servo drive controlled in response to air pressure, wherein the edges laterally confining the passage slot relative to an in-flow direction are of a convex curvature and wherein the closure element, in the form of a leaf spring of a similarly convex yet lesser curvature than the curvature of said edges is formed and arranged behind said edges, with a length of the leaf spring corresponding at least to a length of the convex-curved edges of the passage slot, said leaf spring with one end thereof being held on the frame and with the other end region being guided displaceably on the free.

2. The quick-acting gate valve of claim 1, wherein the end region of the leaf spring displaceably guided on the frame is directly connected to the servo drive.

3. The quick-acting gate valve of claim 1, wherein the convex-curved edges of the passage slot are formed as edges of bridges located in the frame.

4. The quick-acting gate valve of claim 3, wherein the bridges are designed as flank legs of a plural number of M-profiles located in the frame.

5. The quick-acting gate valve of claim 1, wherein a control element extends transverse of the leaf spring with one end thereof firmly disposed on the frame cooperating with the leaf spring and with the other free end being coupled to the servo drive.

6. The quick-acting gate valve of claim 5, wherein the control element extends substantially across the entire width of the frame and to which is hinged several leaf springs with the free ends thereof centrally coupled to the servo drive.

7. The quick-acting gate valve of claim 1, wherein, in relation to the in-flow direction, a flow controlling element is located in front of the passage slot.

* * * * *

UNITED STATES PATENT AND TRADEMARK OFFICE

CERTIFICATE OF CORRECTION

PATENT NO. : 5,351,933

DATED : October 4, 1994

INVENTOR(S) : Bernhard Schonks

It is certified that error appears in the above-indentified patent and that said Letters Patent is hereby corrected as shown below:

Title page, item [75] Inventor, "Frankfurt am Main" should read --Frankfurt/Main--.

Title page, item [56], under References Cited, FOREIGN PATENT DOCUMENTS, "361892 3/1987 Fed. Rep. of Germany ... B61D 27/00" should read --3618292 12/1987 Fed. Rep. of Germany ... B61D 27/00--.

Column 1 Line 19 "last" should read --least--.

Column 3 Line 9 "though" should read --through--.

Column 4 Line 11 after "similar" insert --to--.

Claim 1 Line 22 Column 4 "a least" should read --at least--.

Claim 1 Line 35 Column 4 "free." should read --frame.--.

Signed and Sealed this

Thirteenth Day of December, 1994

*Attest:*

Bruce Lehman

BRUCE LEHMAN

*Attesting Officer*

*Commissioner of Patents and Trademarks*